United States Patent [19]

Brooke et al.

[11] 4,408,428

[45] Oct. 11, 1983

[54] SUSPENDED PANEL CEILING HAVING IMPACT ABSORBENT PANEL RETAINING CLIP ASSEMBLIES

[75] Inventors: Michael E. Brooke, Sharon, Wis.; Alan C. Wendt, Barrington, Ill.

[73] Assignee: United States Gypsum Company, Chicago, Ill.

[21] Appl. No.: 425,751

[22] Filed: Sep. 28, 1982

[51] Int. Cl.[3] ..... E04B 5/52; E06B 3/54

[52] U.S. Cl. ..... 52/489; 52/713; 52/772; 52/773

[58] Field of Search ..... 52/773, 484, 489, 354, 52/355, 713, 772, 358, 359; 24/335, 336, 259 R; 269/43

[56] References Cited

U.S. PATENT DOCUMENTS

| | | | |
|---|---|---|---|
| 1,934,760 | 11/1933 | Awbrey | 52/713 |
| 2,620,531 | 12/1952 | Chandler | 52/358 |
| 3,086,329 | 4/1963 | Schneller | 52/358 |
| 3,834,106 | 9/1974 | Astedt et al. | 52/489 |

FOREIGN PATENT DOCUMENTS

| | | | |
|---|---|---|---|
| 573581 | 8/1945 | United Kingdom | 52/773 |
| 617797 | 2/1949 | United Kingdom | 52/773 |
| 672553 | 5/1952 | United Kingdom | 52/489 |
| 745432 | 2/1956 | United Kingdom | 52/489 |
| 785320 | 10/1957 | United Kingdom | 52/355 |
| 853426 | 11/1960 | United Kingdom | 52/773 |
| 1104685 | 2/1968 | United Kingdom | 52/484 |

*Primary Examiner*—Alfred C. Perham
*Assistant Examiner*—Mark J. Sofia
*Attorney, Agent, or Firm*—Samuel Kurlandsky; Robert H. Robinson; Kenneth E. Roberts

[57] ABSTRACT

Panels resting in a suspended grid are rendered abuse-resistant by mounting two-piece retaining clips atop the runners in the grid. The clip assemblies comprise a torsional/flexural spring mated with a clinch fastener. The spring is a piece of bent music wire having a central U-shaped segment, two opposing legs angling outwardly and downwardly from the upright arms of the U to a level below the cross member of the U. The clinch fastener is a piece of flat spring steel bent into the shape of a U, the bight of the U being a channel connecting two straps, each of which has a keeper at its distal end which turns inward and upward into the space between the two straps. The cross member of the spring fits into the channel of the clinch fastener and the unit is snapped onto the bead atop a grid runner so that the cross member is interposed between the bead and the channel. The retaining clip assemblies may be installed before or after the panels are installed in the grid or the panels and clip assemblies may be installed sequentially. The legs of the spring bear down on the panels and the spring absorbs the impact of a ball or other object thrown upward at the ceiling.

13 Claims, 8 Drawing Figures

SUSPENDED PANEL CEILING HAVING IMPACT ABSORBENT PANEL RETAINING CLIP ASSEMBLIES

This invention relates to paneled ceilings wherein the panels are supported by a suspended grid of runners. More particularly, it relates to such ceilings in gymnasiums, basketball courts, school corridors and the like which are likely to be struck by basketballs, volleyballs, ladders, or outstretched hands. The impact of such blows nearly always dislodges the panels from the grid and often damages them.

In U.S. Pat. No. 3,834,106, Astedt et al. describe a holding clip which is secured to the runners of the grid and resiliently bears against the backs of the panels resting on the runners. The holding clip comprises two complementary spring steel members, each having a broadly curved spring portion, a vertical leg, and a laterally extending U-shaped gripping member at the end of the vertical leg. The vertical legs are riveted together so that the two spring portions face away from each other. Detents in each vertical leg are thus aligned to accommodate the bead atop a web of a runner when the lower ends of the clip are spread apart so that the opposing U-shaped gripping members may be snapped over respective flanges of the runner.

Such a clip must be attached to the runner before a ceiling panel is installed. To gain access to the space above the ceiling, the panels on both sides of the runner must be pushed up to allow the legs to be spread apart far enough to release the runner flanges from the gripping members of the clip. Astedt et al. teach that the gripping members may be deleted in favor of other means of fixing the clip to the runner such as a rivet, bolt or machine screw passing through both legs and the web as it is sandwiched between the legs, an arrangement admittedly making access more difficult.

Another clip marketed by the Perry Co. is a piece of hard drawn steel wire bent into two semi-circular loops connected by a co-planar V-shaped bight, each loop terminating in a foot which is perpendicular to the plane in which both loops lie, said two feet pointing in opposite directions. In use as a ceiling panel retention clip, the wire is passed through a hole in the web of a runner to lodge the web bead in the V-shaped bight.The semi-circular loops are in the upright position. This clip, like the Alstedt et al. clip, cannot be attached to the runner after the ceiling panels are placed in the grid. Also, an upward movement of a panel past the wire segment defining the V-shaped bight would cause the wire to gouge the panel edge. The impact of a ball thrown up to the ceiling or the raising of a panel to gain access to the ceiling plenum would thus cause damage similar to that which was to be prevented.

It is an object of this invention, therefore, to provide a ceiling panel retaining clip assembly which may be attached to the runners of a suspended grid before or after the ceiling panels are installed or sequentially as the panels are being installed.

It is another object of this invention to provide a retaining clip assembly which automatically repositions a ceiling panel in the grid after the panel is hit from below.

It is a further oject of this invention to provide a retaining clip assembly which allows easy access to the ceiling plenum.

It is a related object to provide a retaining clip assembly which can be snapped on or off the runner easily for relocation of the ceiling panels during a remodeling project.

It is yet another object of this invention to provide a ceiling panel retaining clip assembly which will snap completely off of the runner in the event that an excessive impact threatens to bottom out the clip assembly and break the ceiling panel.

It is a still further object of this invention to provide an impact absorbent paneled ceiling for facilities which are prone to abuse.

These and other objects which will become apparent from the drawings and the description thereof are achieved by a two piece retaining clip adapted for resilient attachment to the web of a runner in a suspended grid system, said clip comprising:

a torsional/flexural spring having a central U-shaped segment having two upright arms and a cross member between said arms, a first leg connected to one arm at an acute angle to the vertical plane which passes through both arms and extending below the horizontal plane of said cross member, and a second leg connected to the other arm at an acute angle to said vertical plane and extending below said horizontal plane, said first and second legs extending in opposite directions from said vertical plane, and a clinch fastener having two spaced-apart straps, a channel continuous with and connecting said straps, each strap having a keeper distal from said channel and extending inward and upward into the space therebetween, said channel straddling the cross member of the central U-shaped segment of said spring.

The details of the invention are illustrated in the drawings wherein.

Figure 1:
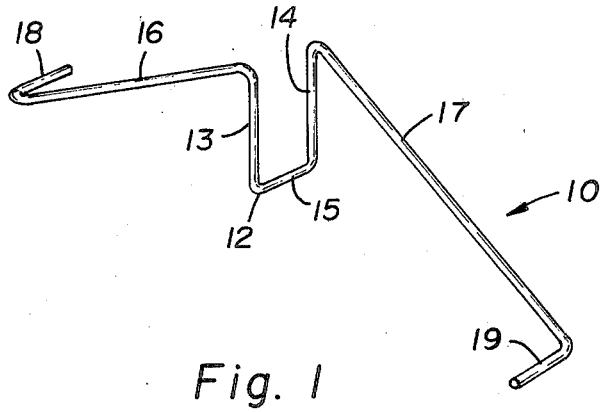
FIG. 1 is a perspective view of a torsional/flexural spring which is one piece of the two piece retaining clip of this invention.
Figure 2:
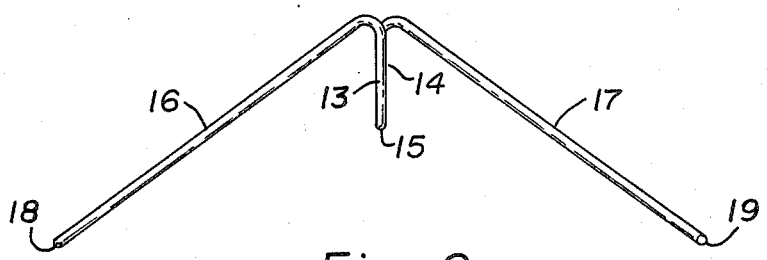
FIG. 2 is a front elevational view of the spring of FIG. 1.
Figure 3:
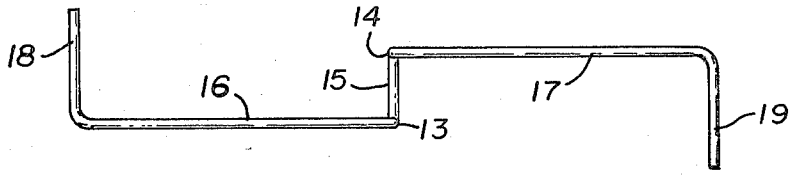
FIG. 3 is a plan view of the spring of FIG. 1.

In FIG. 1, the spring 10 is a piece of steel music wire bent to form a U-shaped central segment 12 having two upright arms 13 and 14 and a torsional cross member 15. A first flexural leg 16 and a second flexural leg 17 extend from said arms 13 and 14, respectively, at an acute angle to the vertical plane which passes through both arms (as shown more clearly in FIG. 2). The legs 16 and 17 have respective oppositely directed feet 18 and 19 which extend at right angles to the vertical plane in which their respective legs lie, as shown by FIG. 3.

Figure 4:
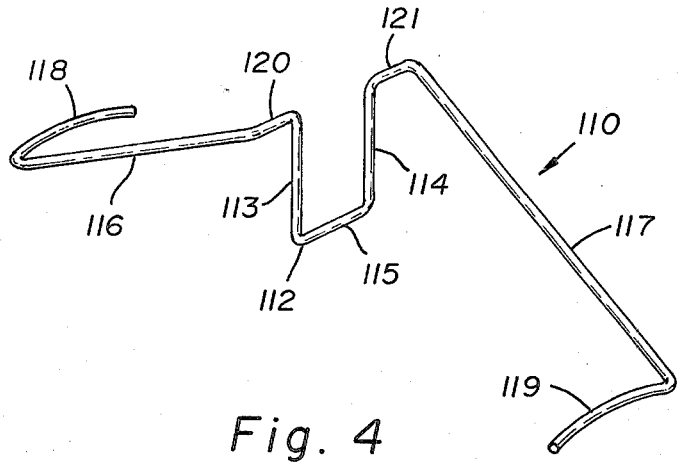
FIG. 4 is a perspective view of another embodiment of the torsional/flexural spring of this invention.

In FIG. 4, the torsional/flexural spring 110 is a preferred element of the retaining clip assembly of this invention. The central U-shaped segment 112, it arms 113, 114 and cross member 115, the legs 116 and 117, and the feet 118 and 119 are all similar to their counterparts in the spring 10 of FIGS. 1, 2, and 3. Here, however, the arms 113 and 114 are connected to the legs 116 and 117, respectively, by the torsional spindles 120 and 121 which are perpendicular to their respective arms. Said spindles act as torsion bars along with the cross member 115. Thus, when either leg 116 or leg 117 is urged upward, the spindles 120 and 121 tend to reduce the deflection of arms 113 and 114 away from the vertical plane in which said arms lie at rest.

Figure 5:
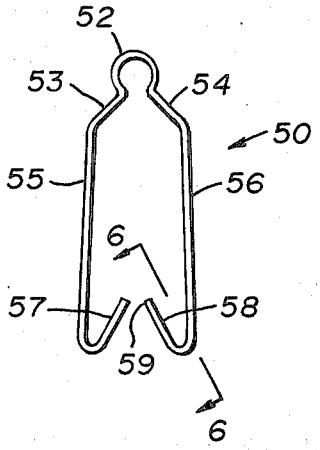
FIG. 5 is a side elevational view of a clinch fastener which in cooperation with the spring comprises a retaining clip of this invention.
Figure 6:
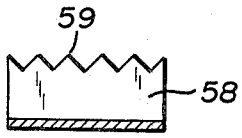
FIG. 6 is a sectional view of the clinch fastener of FIG. 5 taken along line 6—6.

In FIG. 5, the clinch fastener 50 is shaped from flat spring steel. A channel 52 at the apex of the fastener connects shoulders 53 and 54 of the straps 55 and 56 which diverge slightly toward the distal ends thereof and then are bent inward and upward to form the keepers 57 and 58. In FIG. 6, the keeper 58 is shown to have a serrate edge 59; although not shown, it is obvious that the keeper 57 may bave a serrated edge, also.

Figure 7:
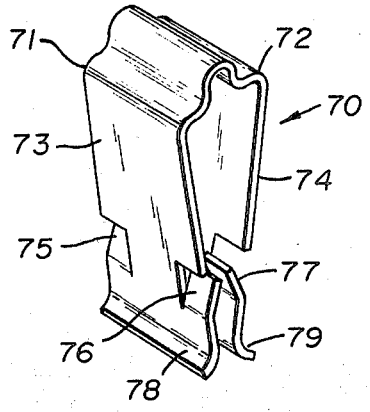
FIG. 7 is a perspective view of another embodiment of the clinch fastener of this invention.

The clinch fastener 70 of FIG. 7 differs from that of the fastener 50 in that the shoulders 71 and 72 are substantially horizontal, the straps 73 and 74 are convergent, and the keepers 75, 76, 77, and a fourth one not shown are shear-formed tongues jutting inward from their respective straps. The fastener 70 also has a pair of grips 78 and 79 which terminate the straps 73 and 74, respectively.

Figure 8:
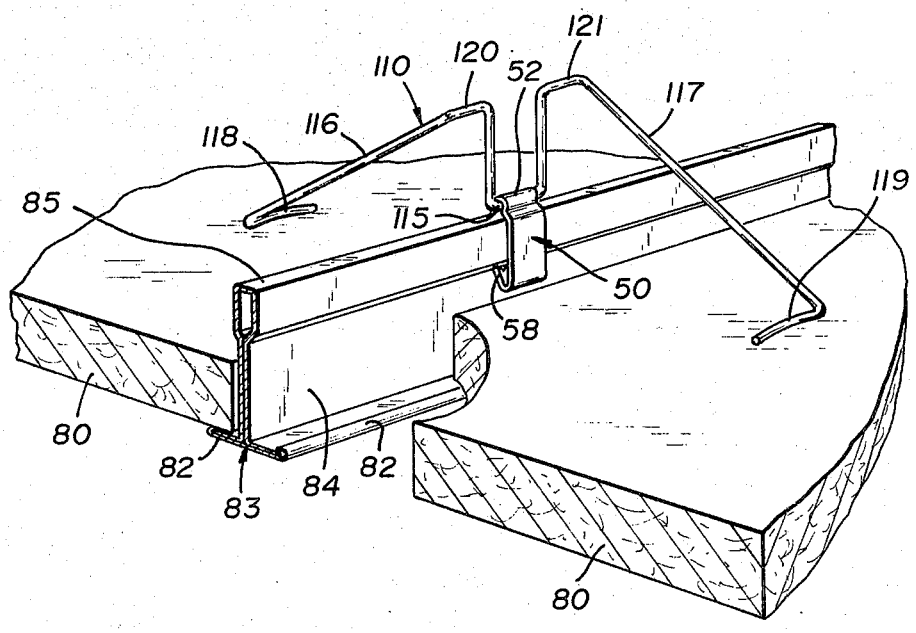
FIG. 8 is a perspective view, partially cut away, of a portion of a ceiling of this invention.

In FIG. 8, part of a ceiling of this invention is shown with a portion cut away to show ceiling panels 80 resting on the flanges 82 of a ceiling grid runner 83 having a web 84, said web having a lateral abutment such as the bead 85. The lateral abutment may be bulbous rather than rectangular. The clinch fastener 50 straddles the bead 85 and the keepers 58 and 59 (not shown) bite into the base of the bead at each side. The cross member 115 of the spring 110 is interposed between the channel 52 of fastener 50 and the bead 85. The legs 116 and 117 project downward so that the feet 118 and 119 bear against the upper surfaces of the panels 80.

The retaining clip assemblies of this invention may be installed on the main runners or cross runners or both. In the case of oblong panels, such as the commonly used 2'×4' sizes, the clip assemblies are placed opposite each other along both longitudinal edges of each panel and spaced about 2 feet apart. Thus, a 2'×4' panel is retained in the grid by four legs, each leg being a part of a separate retaining clip assembly. In the case of 2'×2' panels, two oppositely placed assemblies are used to retain each panel.

The installation of the impact resistant ceiling of this invention is simple and straightforward. It may be done by any one of three methods or a combination thereof. In the first method, the initial panel is laid in the grid and the requisite number of retaining clip assemblies are snapped over the bead of the adjacent runner. The next panel is placed in the grid by pushing up the dangling legs of the in-place torsional/flexural spring with just enough force to allow clearance of the panel through the grid opening. The entire ceiling may be paneled sequentially in this manner. In the second method, a series of two or more panels are laid in the grid. The requisite number of retaining clip assemblies are snapped over the beads of the runners between adjacent panels. In the third method, all of the retaining clip assemblies needed for the entire ceiling grid are snapped onto the beads before any panels are installed. The panels are then installed by pushing up the dangling legs of each clip assembly just far enough to allow a panel to pass through the opening.

Repositioning of an out of place panel is easily done by slight upward pressure against the panel and the clip assembly and turning the panel to fit back into the grid.

Removal of a panel for access to the plenum above the ceiling is accomplished by either of two methods. The panel may be pushed up far enough to allow it to be pushed horizontally out of engagement with the legs of the retaining clip assembly and then away from the opening. To reposition the panel after the plenum work is done, the legs of the clip assembly are pushed up and the panel is slid under the legs and onto the runner flanges. Alternatively, a panel may be removed by pushing it upward with enough force to snap the clinch fastener off of the bead of the runner. When the panel is to be replaced, the same or another retaining clip assembly is snapped onto the bead and the panel placed in the grid as before.

The retaining clip assembly of this invention provides the ceiling panels with sufficient impact resistance to withstand impacts having an energy of as much as 10 footpounds (13.6 joules).

Various embodiments of the invention thus illustrated and described may be suggested hereby to one skilled in the art but still be within the spirit and scope of the appended claims.

We claim:

1. A ceiling comprising:

a suspended grid of main runners and cross runners, said runners having a vertical web and horizontal flanges forming an inverted T in cross section, the webs of at least the cross runners having a lateral abutment;

a plurality of ceiling panels resting on said horizontal flanges;

a clinch fastener mounted on said web by resilient frictional engagement with said lateral abutment, said clinch fastener having two spaced-apart, upright straps, a channel continuous with and connecting said straps at the apex of said fastener, each strap having a keeper distal from said apex and extending inwardly and upwardly into the space therebetween, said channel and straps straddling the web and said keeper biting into said abutment, and a spring having a central U-shaped segment having two upright arms and a cross member between said arms, said cross member being interposed co-axially within said channel, and divergent legs extending downward from the arms of the U at an acute angle to the vertical plane passing through both arms, said legs resting on the inner faces of adjacent panels.

2. The ceiling of claim 1 wherein said straps are convergent.

3. The ceiling of claim 1 wherein said keepers are acutely angular extensions of the straps.

4. The ceiling of claim 1 wherein said keepers are tongues jutting from said straps.

5. The ceiling of claim 1 wherein the spring further comprises first and second torsional spindles, each of which connects an arm to its respective leg, said torsional spindles being perpendicular to said arms.

6. A retaining clip assembly for ceiling panels resting in a suspended grid, said clip comprising:

a spring having a central U-shaped segment having two upright arms and a cross member between said arms, a first leg connected to one arm at an acute angle to the vertical plane which passes through both arms and extending below the horizontal plane of said cross member, and a second leg connected to the other arm at an acute angle to said vertical plane and extending below said horizontal plane, said first and second legs extending in opposite directions from said vertical plane, and a clinch fastener having two spaced-apart straps, a channel continuous with and connecting said straps, each strap having a keeper distal from said channel and extending inward and upward into the space therebetween, said channel straddling the cross member of the central U-shaped segment of said spring.

7. The retaining clip assembly of claim 6 wherein said straps are substantially parallel.

8. The retaining clip assembly of claim 6 wherein said straps are convergent.

9. The retaining clip assembly of claim 6 wherein said keepers are acutely angular extensions of the straps.

10. The retaining clip assembly of claim 6 wherein said keepers are tongues jutting inward from said straps.

11. The retaining clip assembly of claim 6 wherein the spring further comprises first and second torsional spindles, each of which connects an arm to its respective leg, said spindles being perpendicular to said arms.

12. The retaining clip assembly of any one of claims 6 through 11 wherein said legs each have a foot, said feet extending in opposite directions at right angles to the vertical plane in which their respective legs lie.

13. The retaining clip assembly of claim 12 wherein each foot is directed toward the vertical plane in which the other leg lies.

* * * * *